US005990056A

United States Patent [19]

Kremer et al.

[11] Patent Number: 5,990,056

[45] Date of Patent: Nov. 23, 1999

[54] COMPOSITIONS CONTAINING AN ORGANO-SUBSTITUTED BENZOPHENONE

[75] Inventors: Ross Allan Kremer, Lawrenceville, N.J.; Bruce Robert Lundmark, Hulmeville, Pa.

[73] Assignee: Mobil Oil Corporation, Fairfax, Va.

[21] Appl. No.: 08/868,780

[22] Filed: Jun. 4, 1997

[51] Int. Cl.[6] ..... C10M 129/24

[52] U.S. Cl. ..... 508/578

[58] Field of Search ..... 508/578; 568/332, 568/333; C10M 124/24, 105/20

[56] References Cited

U.S. PATENT DOCUMENTS

| | | | |
|---|---|---|---|
| 2,221,380 | 11/1940 | Horsch | 508/578 |
| 2,281,597 | 5/1942 | Prutton | 508/578 |
| 3,282,842 | 11/1966 | Bonner et al. | 508/578 |
| 3,702,299 | 11/1972 | Hartie et al. | 508/578 |
| 4,018,693 | 4/1977 | Mead et al. | 508/578 |
| 4,027,040 | 5/1977 | Deraedt et al. | 424/331 |
| 4,124,726 | 11/1978 | Hamazaki et al. | 424/331 |
| 4,664,829 | 5/1987 | Arakawa et al. . | |
| 5,171,915 | 12/1992 | Forbus et al. | 585/445 |
| 5,254,274 | 10/1993 | Ho et al. . | |

*Primary Examiner*—Jacqueline V. Howard
*Assistant Examiner*—Cephia D. Toomer
*Attorney, Agent, or Firm*—Malcolm D. Keen

[57] ABSTRACT

A lubricant, fuel or other composition comprising an organo-substituted benzophenone in which the latter compound acts as a lubricant base stock, a blend stock, an additive solubility enhancer and/or a deposit reducing agent, and is defined as having at least one ring carbon atom of its benzophenone moiety bonded to an organo radical which is a hydrocarbyl radical containing 1 to about 60 carbon atoms, or such a hydrocarbyl radical modified to contain additional oxygen, nitrogen and/or sulfur. Compositions containing such an organo-substituted benzophenone as the base fluid possess excellent resistance to deposition under severe conditions as well as outstanding thermal and oxidative stabilities.

18 Claims, No Drawings

COMPOSITIONS CONTAINING AN ORGANO-SUBSTITUTED BENZOPHENONE

BACKGROUND OF THE INVENTION

1. Field of the Invention

This invention relates to the use of certain organo-substituted benzophenones in lubricant and other compositions, e.g., fuels, wherein the organo-substituted benzophenone exerts a stabilizing and other beneficial effects.

2. Background of the Invention Including Description of Related Art

Various ring-substituted, e.g., alkylated aromatics are known to function as effective lubricants and other functional compositions in a variety of applications, particularly those requiring any combination of the properties of good viscosity indices, low pour points, good thermal and oxidative stabilities and additive solubilities. However, certain current applications are close to surpassing the stability limits of these base stocks. Upon decomposition, such base stocks often form deposits which are highly undesirable. Thus, any ring-substituted aromatic newly developed for lubricant and other applications which not only possess all the desirable properties of alkylated aromatics previously known for these applications, but also has improved resistance to deposition of solids under severe conditions, is very desirable.

The following references may be considered pertinent to the field of the invention.

U.S. Pat. No. 4,664,829, issued May 12, 1987 to Arakawa et al., discloses a lubricating oil blend comprising a monoalkyldiphenylether or dialkyldiphenylether.

U.S. Pat. No. 5,171,915, issued Dec. 15, 1992 to Forbus et al., and U.S. Pat. No. 5,254,274, issued Oct. 19, 1993 to Ho et al., disclose the catalytic alkylation of any of various aromatic compounds (not including benzophenone), with a mono-olefin which is a dimer or oligomer obtained in the oligomerization of a 1-alkene for the production of high viscosity index polyalpha-olefin (HVI-PAO) lubricants.

SUMMARY OF THE INVENTION

This invention is directed to lubricant, fuel, and other compositions comprising such an organo-substituted benzophenone, in which the latter compound acts as a lubricant base stock, a blend stock, an additive solubility enhancer, and/or a deposit reducing agent, and is defined as having at least one ring carbon atom of its benzophenone moiety bonded to an organo radical which is a hydrocarbyl radical containing 1 to about 60 carbon atoms, or such a hydrocarbyl radical modified to contain additional oxygen, nitrogen and/or sulfur. If such an organo radical is bonded to more than one ring carbon atom of the benzophenone moiety, the organo radicals may be the same or different. It has been found that compositions containing such an organo-substituted benzophenone as the base fluid possess excellent resistance to deposition under severe conditions as well as outstanding thermal and oxidative stabilities.

DETAILED DESCRIPTION OF THE INVENTION

As stated, the organo-substituted benzophenone of this invention have at least one ring carbon atom of the benzophenone moiety bonded to an organo radical which is a hydrocarbyl radical either unmodified or optionally modified to contain oxygen, e.g. ether linkages, nitrogen, e.g.

amine groups, and/or sulfur, e.g. sulfide groups. The contemplated hydrocarbyl radicals, either unmodified or modified as described, may be, for example alkyl, alkenyl, alkynyl, aralkyl, aryl, cycloalkyl, or cycloalkenyl. Such hydrocarbyl radicals can contain, for example, from 1 to about 60 carbon atoms, preferably from about 6 to about 60 carbon atoms, more preferably about 6 to about 20 carbon atoms, and most preferably about 12 to about 18 carbon atoms, and the aliphatic portion of the radical may be linear (straight chain), branched, or cyclic with linear structure often preferred. The organobenzophenone may contain, for example, an average of about 1 to about 4, preferably about 1 to about 2 organo radicals bonded to ring carbon atoms, and the total number of carbon atoms in all the organo radicals collectively may be, for example, about 1 to about 120, preferably about 6 to about 120, and more preferably about 12 to about 30. The organo radicals bonded to the ring carbon atoms of the benzophenone moiety are preferably normal, i.e., terminally bonded linear (straight chain) alkyl radicals.

The organo-substituted benzophenones contemplated under this invention can be synthesized by a Friedel-Crafts reaction in which one reactant is a benzoyl compound in which the ring carbon atoms are unsubstituted or in which one or more of the hydrogen atoms bonded to the ring carbon atoms is substituted with an organo radical as previously defined, and the other reactant is benzene or benzene in which one or more hydrogen atoms is substituted with such an organo radical, with the proviso that at least one hydrogen atom bonded to a ring carbon atom of either reactant is substituted with such an organo radical. Preferably, one of the reactants is benzene in which at least one hydrogen atom has been substituted with an organo radical. The reaction is carried out in the presence of a Lewis acid as is usual with Friedel-Crafts reactions.

The following equation illustrates a reaction for the synthesis of a preferred organobenzophenone containing 1 to 3 organo radicals bonded to ring carbon atoms of the benzophenone moiety:

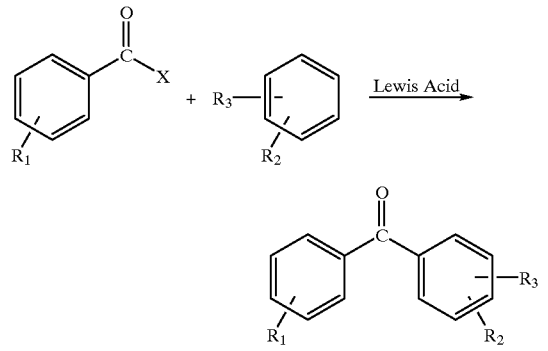

where $R_1$ and $R_2$ are hydrogen or $C_1$ to $C_{60}$ hydrocarbyl, and may be the same or different, $R_3$ is $C_1$ to $C_{60}$ hydrocarbyl, and X is OH, $OCH_3$, OCOPh, or halide, e.g. chloride or bromide. $R_1$, $R_2$ and $R_3$ can optionally be modified to contain oxygen, nitrogen, and/or sulfur.

As indicated by the foregoing equation and substituents, the benzoyl compound may be, for example, benzoic acid, an alkyl benzoate such as methyl benzoate, benzoic anhydride or a benzoyl halide such as benzoyl chloride or benzoyl bromide, wherein the hydrogen atoms bonded to the ring carbon atoms are either unsubstituted, or an organo radical as previously defined is substituted for one of such hydrogen atoms, and the other reactant is a derivative of benzene in which such organo radicals are substituted for one or two of the hydrogen atoms. The reaction can be carried out under conditions which are well-known in the art for the synthesis of ketones and in which the Lewis acid catalyst may be, for example, aluminum chloride, boron trifluoride, an acid zeolite or an acidic ion-exchange resin. The preferred catalyst is aluminum chloride.

The organo-substituted benzophenone may be used as the main base stock oil in lubricant or fuel compositions or in combination with other synthetic and/or mineral oil fluids. In either case, it will generally have a viscosity in the range, for example, of about 2 to about 1000 cSt, preferably about 3 to about 100 cSt, and more preferably about 3 to about 30 cSt, at 100° C., and be present in the composition in the range, for example, of about 0.5 to about 95 wt. % or more, preferably about 2 to about 90 wt. %, more preferably about 5 to about 30 wt. %, and most preferably about 5 to about 25 wt % based on the weight of the total base stocks oil, with the remainder being another synthetic or mineral oil, as described hereinafter.

In general, mineral oils, including paraffinic, naphthenic, and aromatic oils and mixtures thereof, employed as part of base stock oil in the lubricant, or grease vehicle, may be of any suitable lubricating viscosity range, as for example, from about 1.0 cSt at 100° C. to about 1000 cSt at 100° C. and preferably, from about 2.0 to about 60 cSt at 100° C. The preferred oils may have viscosity indexes ranging to about 150. The average molecular weights of these oils may range from about 250 to about 800.

In instances where synthetic oils, or synthetic oils employed as the lubricant or vehicle for the grease, are desired in preference to mineral oils, or in combination therewith, various compounds of this type may be successfully utilized. Typical synthetic oils of lubricating viscosity include, but are not limited to, polyalphaolefins, e.g., polyisobutylene, polybutenes, or hydrogenated polydecenes, polypropylene glycol, polyethylene glycol, trimethylpropane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes) and alkyl-substituted diphenyl ethers.

The compositions of the invention may also be used in greases or in any of the foregoing synthetic and/or mineral base stock oils thickened with an appropriate thickener. When the lubricant is to be employed in the form of a grease, the lubricating oil is generally employed in an amount sufficient to balance the total grease composition, after accounting for the desired quantity of the thickening agent, and other additive components to be included in the grease formulation.

A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other aspects, any material which is normally employed for thickening or gelling hydrocarbon fluids for forming greases can be used in preparing greases in accordance with the present invention.

In addition to the organo-substituted benzophenone of this invention and an additional synthetic or mineral base stock oil, if used, various combinations of other components commonly used in lubricants and other functional fluids may also be included, e.g., dispersants such as polymer-substituted succinimides and other succinyl derivatives, metallic, e.g., derived from calcium or magnesium, or non-metallic detergents (phenates, sulfonates, and/or salicylates), antioxidants (as exemplified by hindered phenols, arylamines, dithiocarbamates, etc.), polymeric viscosity index improvers (polyisobutylene, styrene-diene copolymers, polymethacrylates, etc.), auxiliary antiwear or extreme pressure additives (heterocyclic triazoles, dimercaptothiadiazoles, dithiocarbamates, phosphites, phosphonates, acid phosphates, thiophosphates, e.g., zinc and other metal dithiophosphates, phosphonothionates, borates, etc.), corrosion inhibitors, emulsifiers, demulsifiers, seal swell agents, antistain additives, and the like.

When formulated as a lubricant, the composition of this invention can be used in demanding applications such as diesel engine oils which generate large quantities of performance-property robbing particulate soot, or in somewhat less demanding applications such as turbine, circulating, or hydraulic oils, or in thickened lubricants such as greases.

Although the preferred use of the composition of this invention may reside in lubricant applications, use in fuels would also provide many of the same performance advantages. Concentrations of 1 to 1,000 pounds of components per thousand barrels of fuel are preferred. Fuel compositions include hydrocarbon fuels, oxygenated fuels, and mixtures of hydrocarbon and oxygenated fuels. Use of a mixture of aromatic fluid and dispersant would be especially advantageous in fuels.

The following examples further illustrate the invention.

EXAMPLE 1

Reaction Product of an Alkylated benzene and Benzoyl Chloride

Approximately 580 mL (5.0 moles) of benzoyl chloride and 1520 mL (5.0 moles) of Nalkylene 600L ( a mixture of $C_{12}$, $C_{13}$, and $C_{14}$ alkylated benzene commercially available from Vista Chemical Corp.) were charged into a 5 L 4-neck round bottom flask equipped with a mechanical stirrer, a thermometer, a nitrogen inlet, and a condenser with a nitrogen outlet. The nitrogen outlet was connected to a gas dispersion tube immersed in 2.5 L of 10M NaOH to trap the HCl gas which was evolved during the reaction. Approximately 667 g (5.0 moles) of aluminum chloride was added in four equal portions over approximately 3 hours. Approximately 750 mL of toluene was added to the reaction mixture. The aluminum chloride was quenched using approximately 2 L of 8M NaOH. The organic layer was separated from the aqueous, and was further washed with 4×750 mL 2M NaOH, and 2×750 mL of distilled water. Approximately 50 g each of activated carbon and basic aluminum oxide were added to the organics, and the mixture was heated at 125° C. with stirring for 16 hours. The mixture was filtered and the volatile organics were removed under high vacuum at 95° C. to give 1.55 kg light yellow-orange oil. The product purity was determined by gas chromatography to be >98%.

EXAMPLE 2

Reaction Product of Heptylbenzene and 4-n-Hexylbenzoyl Chloride

Approximately 145 mL (0.67 moles) of 4-n-hexylbenzoyl chloride and 157 mL (0.67 moles) of n-heptylbenzene were charged into a 1 L 4-neck round bottom flask equipped with a mechanical stirrer, a thermometer, a nitrogen inlet, and a condenser with a nitrogen outlet. The nitrogen outlet was connected to a gas dispersion tube immersed in 500 mL of 2M NaOH to trap the HCl gas which was evolved during the reaction. Approximately 89 g (0.67 moles) of aluminum chloride was added in four equal portions over approximately 3 hours. Approximately 100 mL of toluene was added to the reaction mixture. The aluminum chloride was quenched using approximately 50 mL of 4M NaOH. The organic layer was separated from the aqueous, and was further washed with 4×100 mL 2M NaOH, and 2×100 mL of distilled water. Approximately 10 g each of activated carbon and basic aluminum oxide were added to the organics, and the mixture was heated at 125° C. with stirring for 16 hours. The mixture was filtered and the volatile organics were removed under high vacuum at 95° C. to give 300 g of light yellow oil. The product purity was determined by gas chromatography to be >98%.

The products of the above examples were evaluated with respect to their inherent tendency to form deposits in the hot tube deposit test. At the conclusion of the test, the tubes are visually rated by comparing the tubes to a series of standard tubes. The rating scale is from one to nine with the deposits becoming progressively worse with each increasing number. A tube with a deposit rating one of has very little or no deposits, and a tube with a rating of nine is black and opaque with very heavy deposits.

The tests were carried out by passing the lubricant sample at a rate of 0.35 cc/hour and air at a rate of 10 cc/min. through a tube at 335° C. for 16 hours. This test resulted in a score of 2 indicating a very light deposit in the tube left by the product of each of Examples 1 and 2.

As a comparison, the foregoing hot tube deposit test was carried out on four known synthetic lubricants not within the scope of the invention, viz., a polyalphaolefin, di(2-ethylhexyl)adipate, an alkylated benzene and an alkylated naphthalene. Each of these lubricants received at rating of 9, indicating the formation of very heavy deposits resulting in a black and opaque tube.

As an indication of the formation of deposits under somewhat different conditions, i.e., on an open surface exposed to the atmosphere and at a somewhat lower temperature, the products of Examples 1 and 2 were evaluated with respect to their inherent tendency to form deposits in the RAMP deposit test. The RAMP is an inclined metal surface which is heated to a fixed temperature, in this case 575° F. The sample is introduced onto the top of the plate and left on the plate for a period of three minutes. The sample is then wiped from the plate, and the plate is visually inspected for deposits. The rating scale ranges in five steps from excellent to poor. The results of this test were a rating of E (excellent) for the product of Example 1 and a rating of G (good) for the product of Example 2.

In summary, the results of the foregoing tests indicate that organo-substituted benzophenones have a remarkably high resistance to deposition under extremely severe conditions, as compared with other alkylated aromatics such as alkylated benzene and naphthalene, and non-aromatic synthetic lubricants such as polyalphaolefin and adipate esters. In addition, it is likely that the organo-substituted benzophenones of this invention will have improved thermal, oxidative and photochemical stability as well as enhanced antiwear, extreme pressure and friction-modifying properties, because of the ketone structure in the core aromatic compound. Finally, the organo-substituted benzophenones of this invention will possess the usual desirable properties of alkylated aromatics such as good viscosity indexes, low pour points, exceptional additive solubility and excellent compatibility with commonly used lubricants and additives.

We claim:

1. A lubricant composition comprising (i) an organo-substituted benzophenone in which the latter compound acts as a lubricant base stock, a blend stock, an additive solubility enhancer and/or a deposit reducing agent and is defined as having the ring carbon atoms unsubstituted or substituted by a hydrocarbyl radical containing 1 to about 60 carbon atoms, or such a hydrocarbyl radical modified to contain oxygen, nitrogen and/or sulfur with at least one ring carbon atom bonded to such a hydrocarbyl or substituted hydrocarbyl radical and (ii) at least one component selected from lubricant dispersants, lubricant detergents, lubricant antioxidants, viscosity index improvers, antiwear additives or extreme pressure additives, corrosion inhibitors, emulsifiers, demulsifiers, seal swell agents or antistain additives.

2. The composition of claim 1 wherein said organo radical is said hydrocarbyl radical.

3. The composition of claim 1 wherein said hydrocarbyl radical is alkyl.

4. The composition of claim 3 wherein said hydrocarbyl radical is a normal alkyl.

5. The composition of claim 1 wherein said organo-substituted benzophenone contains an average of about 1 to about 4 of said organo radicals.

6. The composition of claim 5 wherein the number of said organo radicals is an average of about 1 to about 2.

7. The composition of claim 1 wherein the number of carbon atoms in all of said organo radicals collectively is about 1 to about 120.

8. The composition of claim 7 wherein said number of carbon atoms is about 12 to about 30.

9. The composition of claim 1 which is a lubricating composition and also comprises a mineral oil, a synthetic oil other than said organo-substituted benzophenone, or a mixture of mineral and said other synthetic oil, of lubricating viscosity.

10. The composition of claim 9 wherein said organo-substituted benzophenone is present in an amount of from about 0.5 to about 95 wt. %, based on the weight of total base stock oil.

11. The composition of claim 10 wherein said organo-substituted benzophenone is present in an amount of about 2 to about 90 wt. %.

12. The copmposition of claim 11 wherein said organo-substituted benzophenone is present in an amount of about 5 to about 25 wt. %.

13. The composition of claim 9 comprising a mineral oil.

14. The composition of claim 9 comprising a synthetic oil.

15. The composition of claim 14 wherein said synthetic oil is a hydrocarbon oil.

16. The composition of claim 15 wherein said hydrocarbon oil is a polyalpha-olefin.

17. The composition of claim 9 comprising a mixture of mineral and said other synthetic oil.

18. The composition of claim 9 wherein said mineral oil, other synthetic oil or mixture of mineral oil and other synthetic oil is in the form of a grease.

* * * * *